United States Patent [19]

Akhavi

[11] Patent Number: 4,541,206

[45] Date of Patent: Sep. 17, 1985

[54] FIXTURE FOR HOLDING AN OPTICAL LENS DURING TUMBLING

[75] Inventor: David S. Akhavi, Westwood, Calif.

[73] Assignee: Iolab Corp., Covina, Calif.

[21] Appl. No.: 542,793

[22] Filed: Oct. 17, 1983

[51] Int. Cl.[4] ..... B24B 31/00

[52] U.S. Cl. ..... 51/217 L; 51/163.1

[58] Field of Search ..... 51/217 L, 216 LP, 163.1, 51/227 R; 81/121 A

[56] References Cited

U.S. PATENT DOCUMENTS

| | | | |
|---|---|---|---|
| 768,713 | 8/1904 | Wilhelm | 51/217 L |
| 1,297,660 | 3/1919 | Collins | 51/217 L |
| 2,166,037 | 7/1939 | Campos | 51/217 L |
| 2,304,984 | 12/1942 | Wood | 51/217 L |
| 2,342,146 | 2/1944 | Joyce | 51/217 L |
| 2,649,823 | 8/1953 | Markovich | 81/121 A |
| 2,715,347 | 8/1955 | Johnson | 81/121 A |
| 3,032,936 | 5/1962 | Voice | 51/216 LP |
| 3,460,928 | 8/1969 | Casko | 51/216 LP |
| 4,447,992 | 5/1984 | Berquist | 51/163.1 |

*Primary Examiner*—Harold D. Whitehead

*Attorney, Agent, or Firm*—Donal B. Tobin

[57] ABSTRACT

A fixture for holding an optical lens during processing which includes a first lens holder having a lens-covering surface and an exterior surface and a second lens holder with a lens-covering surface and an exterior surface. The lens-covering surfaces are placed over the confronting surface of a lens, and the entire assembly is clipped together so that it may be subjected to the manufacturing processes, for example abrasive tumbling to round the exposed edges of the lens.

21 Claims, 7 Drawing Figures

66
3
18
12
10
16
20
14
68
3

62
62
60
64
64
62
20

36
38
12
54
56
26
34
28
22
24
50
30
16
32
52
14
40
42

FIXTURE FOR HOLDING AN OPTICAL LENS DURING TUMBLING

FIELD OF THE INVENTION

The present invention relates to a fixture for holding a lens during processing and more particularly to a fixture for holding an intraocular lens during abrasive tumbling to round sharp edges of the lens.

BACKGROUND OF THE INVENTION

Intraocular lenses may be used as surgical implants to replace the natural lens of the eye that has been removed to correct some vision impairment, for example cataracts. Intraocular lenses generally have two principal parts, a light focusing optic supported in a central position within the eye by means of haptic supports. There are a variety of lens designs available. The optic may be supported by plastic filaments which extend from the optic to the peripheral anatomy of the eye. Alternatively, the optic may be supported by solid haptics which are formed as an integral part of the optic. The type of lenses which use plastic support haptics are shown, for example, in U.S. Pat. No. 4,159,546. Lenses with solid support haptics are shown, for example, in U.S. Pat. No. 4,261,065.

The optic portion of the lens usually has an anterior and a posterior optical surface spaced axially apart from one another and a surrounding circumferential edge. The most commonly used optic has a convex anterior surface and a planar posterior surface. The majority of the light impinging on the eye is focused on the retina by a central optical portion of the lens surfaces. Surrounding this central portion is a peripheral transition zone which is between the central portion and the edge of the lens. It will be appreciated that all surfaces of the intraocular lens should be smooth and rounded to avoid damaging the interior anatomy of the eye during intraocular lens implant surgery or during use of the lens after implantation. For lenses which are supported by plastic filaments the transition between the edges of the optic and the anterior and posterior optical surfaces should be smooth to avoid damaging the interior portions of the eye with which the edges may come in contact. For solid one-piece lenses, it is also important that the edges of the haptic supports also be rounded for the same purpose.

A variety of well-known polishing and cutting processes are used to smooth the rough edges of lenses. These processes can be expensive and time consuming. Lenses which are lathe cut from one piece of hard plastic can have their edges smoothed by tumbling in an abrasive medium. However, abrasive tumbling can change the geometric shape of the optical surfaces of the lens and, hence, the optical properties of the lens so that after tumbling the optical properties of each lens must be carefully checked. It would be desirable if a method and apparatus could be found for permitting the edges of intraocular lenses to be rounded by an abrasive tumbling process which would not require the careful verification of the fidelity of the optical properties of the lens.

It would also be desirable to have a fixture for holding the lens during a variety of processing steps to which a lens must be subjected. For molded optics, processing steps include removing molding gates and flash material that remains on the lens after molding, rounding the edges of the lens and drilling various positioning holes and haptic support holes. It would also be desirable to use one fixture in which a lens could be passed from one manufacturing station to another so that human handling of the optical portion of the lens could be reduced. Such a fixture would also facilitate automated manufacturing of intraocular lenses.

SUMMARY OF THE INVENTION

The present invention provides a fixture for rounding the edges of an optical lens and is particularly well suited for intraocular lenses but can also be used for contact lenses and other general purpose lenses. The fixture can be used to hold only the optic of a lens that is supported by plastic filament haptics or it can be used to hold an entire one-piece lens where the optic and the haptics are made of one piece.

The fixture of the present invention includes two generally cylindrical lens holders each of which has a lens-protecting surface for covering an optical surface of the lens and an exterior surface spaced axially apart from the lens-protecting surface. The lens holders may be made of a variety of plastics or some other suitable material. The two lens holders are placed on opposite sides of the lens and held together so that the fixture and the lens form a unitary assembly for handling during the manufacturing process. The diameter of the lens holders is less than the diameter of the optic so that the edge of the optic and the peripheral transition zone will remain outside of the lens holders so that it may be properly processed. The fixture of the present invention is particularly useful for holding a lens and protecting the optical surfaces of the lens during abrasive tumbling to round the edges of the lens.

In the preferred embodiment, the lens holders are held together on opposite sides of the lens by using a resilient clip which can be made of metal, plastic or some other suitable material. Each holder can include a central support portion extending coaxially from the exterior surfaces of each lens holder. Each support portion includes a coaxial bore into which one end of a generally C-shaped spring may fit to hold the two parts of the lens holder together about the lens. Alternatively, the lens holders can be integrally joined by a piece of resilient plastic so that the lens holders and the spring can be made as a one-piece unit. Further holding force may be obtained by applying a generally U-shaped clamp to the opposite exterior surfaces of the lens holders to hold the lens holders about the lens.

Each lens holder may be made of molded plastic or some other suitable material, and the lens-protecting surface may be shaped to conform generally to the confronting surface of the lens. For a plano-convex lens, one lens holder would have a planar surface covering the plano surface of the lens, and the other lens holder would have a concave surface covering the convex surface of the lens.

O-rings or gaskets may be provided between the confronting surfaces of the lens holders and the optical surfaces of the lens to provide a seal to prevent abrasive medium from contacting the optical surface of the lens. As an alternative to an O-ring, wax, adhesive or a rubber disc may be used between the confronting surfaces of the lens holders and the optical surfaces of the lens. Alternatively, the O-rings may be eliminated and the lens holders may be made of elastomeric material which seals tightly against the optical surfaces of the lens and prevents abrasive material from contacting the optical surfaces of the lens. The lens-protecting surface of both lens holders would have the same shape. Each would have a central recess and a peripheral flange contacting the optical surface of the lens and since the lens holder is made of an elastomeric material, the flange would form a seal with the surface of the lens to prevent abrasives from contacting the lens surface.

Each lens holder may include a radially extending bumper which has a diameter substantially equal to the diameter of the optic itself and which extends an axial distance along the holder toward the lens covering surface to provide a bumper for reducing the possibility that large objects will inadvertently contact the exposed periphery of the lens during processing, particularly during abrasive tumbling of a large number of fixtures together in the same abrasive medium.

The present disclosure also includes the process of rounding the edges in an abrasive medium without changing the geometry and optical properties of the central optical portion of the lens.

The present invention also includes a centering fixture for properly aligning the lens holder elements and the lens to provide a properly aligned and centered lens holder and lens assembly.

It will be appreciated that the fixture of the present invention is particularly well suited to the process of rounding lens edges by abrasive tumbling. The fixture may also be used to handle the lens during a variety of manufacturing steps and for passing the lens from one manufacturing station to another with a minimum of human handling of the optical surfaces of the lens. It is also apparent that this fixture can be used to facilitate automated manufacture of lenses.

These and other features and advantages of the present invention will become more apparent from the following detailed description of the preferred embodiments taken in conjunction with the following drawings.

DETAILED DESCRIPTION OF THE PREFERRED EMBODIMENT

Figure 1:
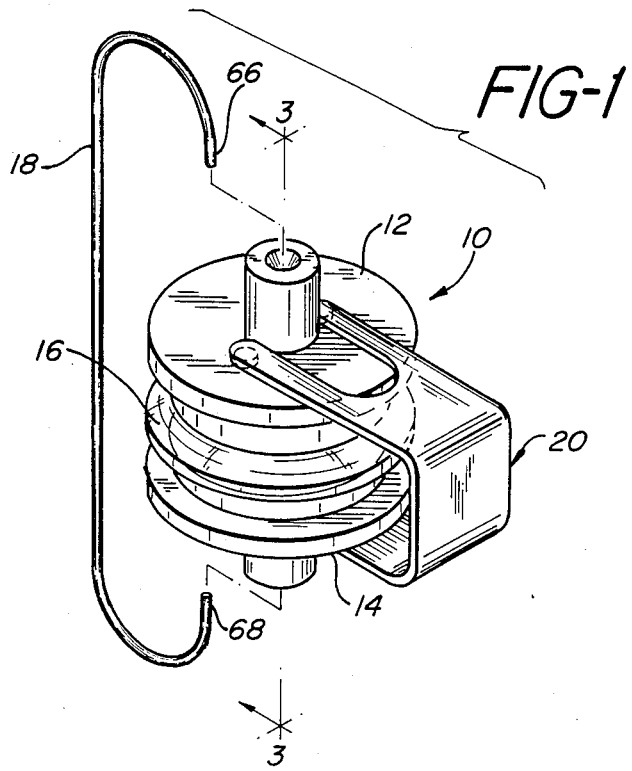
FIG. 1 shows a perspective view of the fixture of the present invention.

Referring now to FIG. 1 there is shown a fixture 10 of the present invention including a first lens holder 12 and a second lens holder 14 placed on opposite surfaces of lens 16 and held in position by clip 18 and/or clamp 20. Holders 12 and 14 may be made of a durable, plastic-like polyvinylchloride, polyurethane, silicone, KRATON* or DELRIN*. Clip 18 is made of a metal or plastic spring material and, as will be explained in more detail later in the application, is used to hold the lens holders 12 and 14 about lens 16 as a unitary assembly. U-shaped clamp 20 is also made of a metal or plastic spring-like material and, as will be explained later in the application in greater detail, is used to provide additional holding force for holding lens holders 12 and –on the opposite sides of lens 16 during handling in the manufacturing process. Alternatively, as will be explained in connection with FIG. 7, fixture 10 and clip 18 may be made as a unitary piece, or a metal clip 18 may be insert molded with plastic lens holders 12 and 14 to form an integral structure. ≠* Trademarks of Shell Chemical Company and E. I. Dupont de Nemours & Co., respectively.

Figure 3:
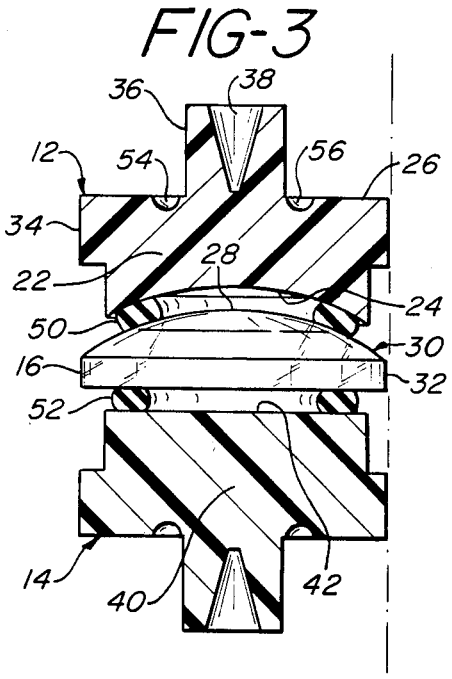
FIG. 3 shows a cross-sectional view of the fixture of FIG. 1 taken along lines 3—3 in FIG. 1.

Referring now to FIG. 3 there is shown a cross-sectional view of fixture 10 assembled about lens 16. Lens holder 12 has a generally cylindrical body 22 having a concave lens-protecting surface 24 and an exterior surface 26 spaced axially apart from lens-protecting surface 24. Lens-protecting surface 24 has a generally concave shape to accommodate the convex optical surface of lens 16. The diameter of lens body 22 is less than the diameter of lens 16. Lens-protecting surface 24 covers the central optical portion 28 of lens 16. A peripheral transition portion 30 which extends radially outwardly of central optical portion 28 and edge 32 of lens 16 project outside the periphery of holder body 22.

* Trademarks of Shell Chemical Company and e. I. DuPont de Nemours & Co., respectively.

The body portion 22 of the first lens holder 12 includes a radially extending flange 34 which has a diameter substantially equal to the diameter of lens 16. Flange 34 extends axially from exterior surface 26 of body portion 22 in the direction toward the lens-protecting surface 24 a predetermined amount but does not extend all the way to lens-protecting surface 24. As will be explained later in the application, flange 34 acts as a bumper to protect the projecting peripheral transition portion 30 and edge 32 of lens 16 from damage during handling.

Still referring to FIG. 3, body portion 22 of lens holder 12 includes a central support portion 36 extending coaxially from exterior surface 26 in a direction away from lens covering surface 24.

A coaxial bore 38 extends into central support section 36. Bore 38 is preferably cone-shaped for accommodating the end of C-clip 18. Bore 38 may be any convenient shape, however.

Body section 40 of second lens holder 14 is substantially the same shape as that of first holder 12. However, lens-protecting surface 42 of body 40 is planar to match the confronting planar surface of lens 16. Of course, the lens-protecting surfaces 24 and 40 of holders 12 and 14, respectivley, can be any desired shape to accommodate a variety of lenses and not just the plano-convex lens 16 shown in FIG. 3.

Still referring to FIG. 3, an optional O-ring 50 may be placed between the confronting lens-protecting surface 24 and optical surface 28 of lens 16 to provide a means for holding lens 16 and lens holder 12 together and for providing a seal for preventing the entry of undesired material between lens-protecting surface 24 and optical surface 28. A similar O-ring 52 may be placed between lens-protecting surface 42 of holder 14 and the confronting planar surface of lens 16. When holders 12 and 14 are pushed together, O-rings 50 and 52 will be compressed to form a suction to hold the assembly of holders 12 and 14 about lens 16.

Alternatively, different kinds of gasket elements can be used. A silicone or rubber disc may be inserted between holders 12 and 14 and their respective confronting surfaces of lens 16 in place of O-rings 50 and 52. An adhesive or a wax can also be used in place of O-rings 50 and 52. It is also possible to introduce a vacuum into the space provided between the confronting lens-protecting surfaces 24 and 42 and the respective confronting surface of the lens 16.

Still referring to FIG. 3 depressions 54 and 56 are included in exterior surface 26 of holders 12 and 14.

Figure 2:
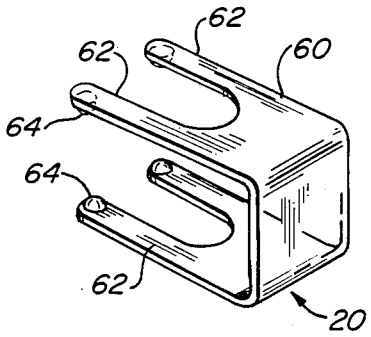
FIG. 2 shows a perspective view of a clamp of the present invention.

Referring now to FIG. 2, there is shown a generally U-shaped clamp 20 made of a spring metal or plastic for holding lens holders 12 and 14 together about lens 16.

Each of the legs 60 of clamp 20 is bifurcated into two prongs 62. The interior facing surface of prongs 62 includes projections 64 which fit into depressions 54 and 56 when clamp 20 is clamped about lens holders 12 and 14 to hold clamp 20 in position.

Referring again to FIG. 1, clip 18 is a generally C-shaped clip made of spring metal or plastic material which has a first end 66 and a second end 68. To assemble clip 18 onto lens holders 12 and 14, clip 18 is expanded so that the distance between ends 66 and 68 is greater than the complete thickness of the assembled lens holders 12, 14 and lens 16. When clip is centered over bores 38, the clip is allowed to relax so that ends 66 and 68 seat in the bottom of bores 38 on the respective central support portions 36 of lens holders 12 and 14. Clip 18 provides a further alternative means for holding lens holders 12 and 14 together about lens 16.

Figure 4:
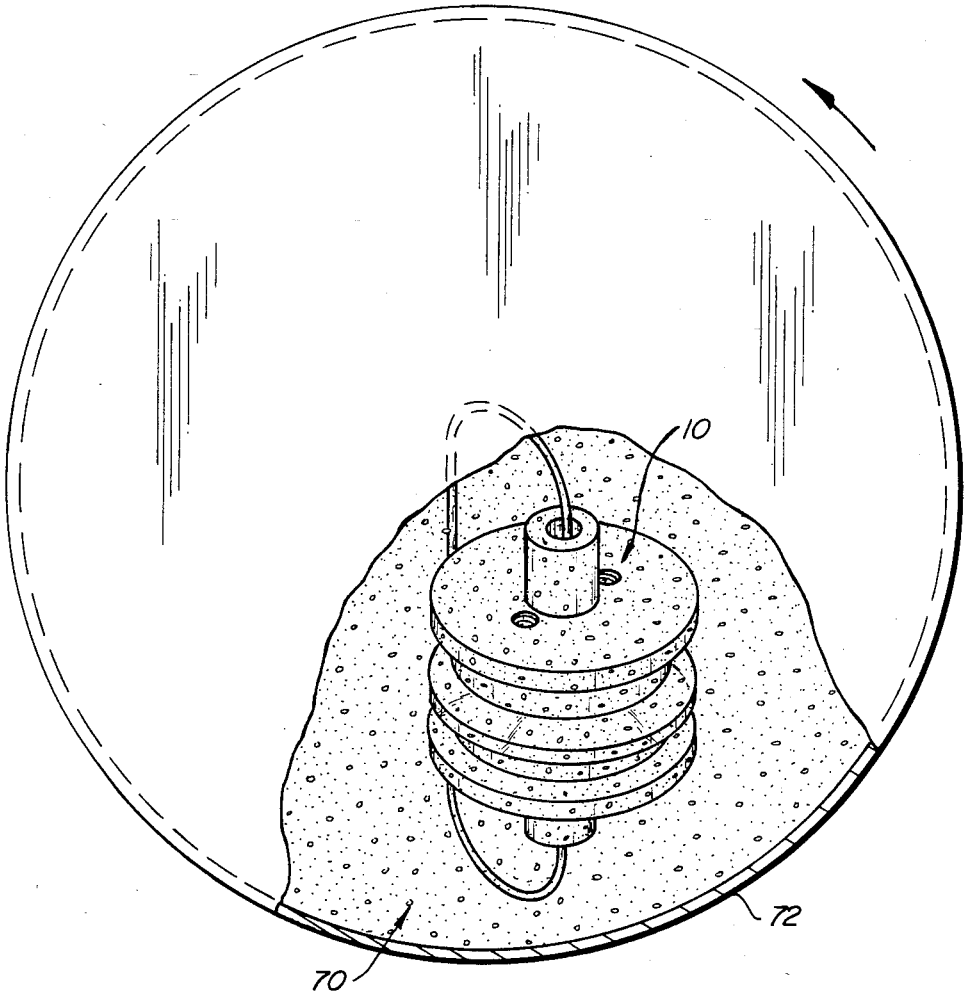
FIG. 4 shows the fixture of the present invention together with a lens in an abrasive tumbling medium.

Referring now to FIG. 4, there is shown the assembled fixture 10 with lens holders 12 and 14 placed about lens 16 and held in position by means of clip 18. The assembly is placed in an abrasive medium 70 in a rotating tumbler 72 shown schematically in FIG. 4. A large number of assemblies 10 may be placed in abrasive medium 70 at the same time so that as the tumbler 72 rotates, abrasive medium 70 contacts the exposed peripheral transition portion 30 and edge 32 of lens 16 to produce a rounded edge to the lens 16. Abrasive medium 70 and tumbler 72 are both well known to those skilled in this art and, thus, will not be described further in this application.

Referring again to FIG. 3, it will be noted that bumper flange 34 extends a sufficient distance axially along lens holders 12 and 14 so that the exposed peripheral portion 30 and edge 32 of lens 16 will not be likely to bump into another assembly 10 in abrasive medium 70. This bumper permits abrasive medium 70 to contact the exposed portion of the lens 16 but protects lens 16 from being bumped by other assemblies 10 in the abrasive medium 70.

Referring again to FIG. 3, it will be noted that the diameter of bumper flange 34 is substantially equal to the diameter of lens 16. The presence of flange 34 permits holders 12 and 14 and lens 16 to be coaxially aligned with one another.

Figure 5:
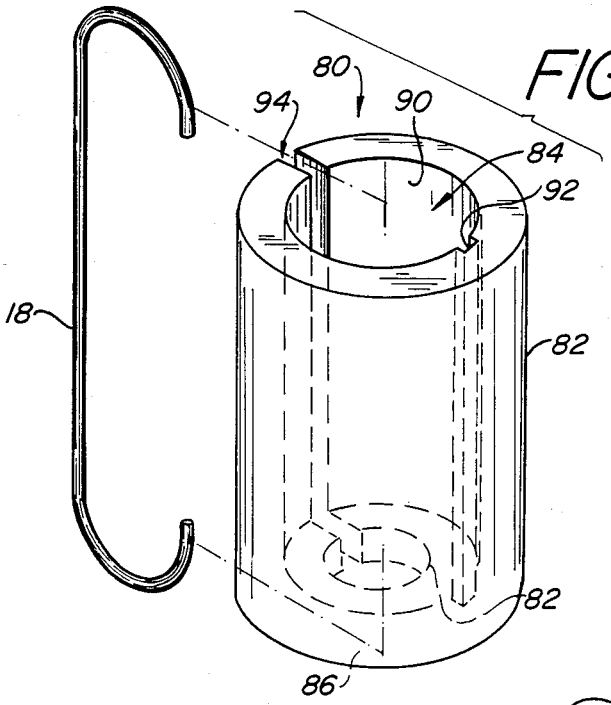
FIG. 5 shows a centering fixture of the present invention.
Figure 6:
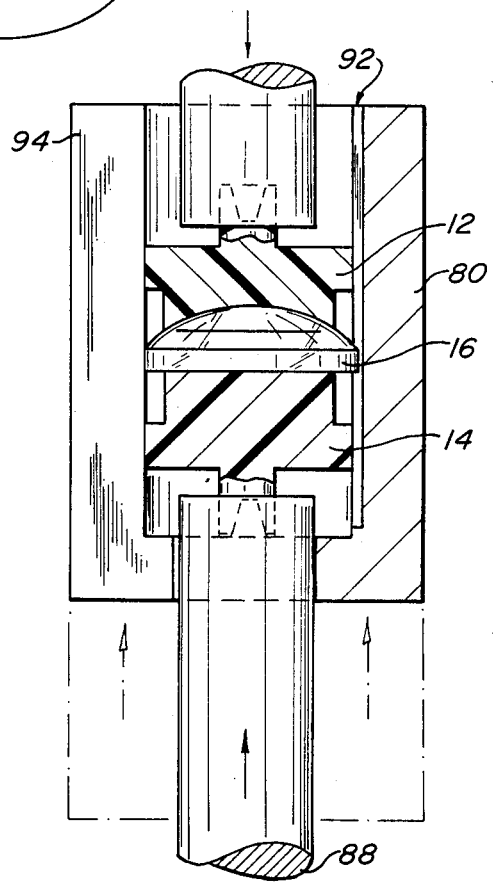
FIG. 6 shows a cross-sectional view of the centering fixture.

Referring now to FIGS. 5 and 6, there is shown a fixture 80 for centering lens 16 and holders 14 and 16. Centering fixture 80 is a generally cylindrical container having a surrounding annular wall 82 with an open end 84 and a closed end 86. Closed end 86 includes a coaxially aligned bore 88 which, as shown in FIG. 6, allows centering fixture 80 to slide on shaft 89. The interior surface 90 of sidewall 82 has a groove 92 for receiving a molding gate that may be left on a molded intraocular lens 16 after it is removed from the mold. Groove 92 is necessary to permit the lens to be inserted within centering fixture 80 before the gate is removed.

Wall 82 also has a slot 94 extending radially completely through wall 82 and axially all the way along wall 82 and through closed end 86 into communication with bore 88. After holder 14, lens 16 and holder 12 are inserted within centering fixture 80, a clip 18 may be inserted around the assembly by introducing clip 18 through slot 94 in wall 82 of container 80. Before clip 18 may be put into position, shaft 89 must be moved so that bore 38 of lens holder 14 is accessible to clip 18. The diameter of centering fixture 80 is substantially the same as the diameter of lens holders 12, 14 and lens 16 so that they may be properly centered coaxially with respect to one another in centering fixture 80. Once clip 18 is placed on the assembled lens holders 12 and 14 and lens 16, the entire assembly may be removed from centering fixture 80. The fixture of the present invention is thus assembled so that the lens may be processed through a variety of manufacturing steps including tumbling.

While lens 16 is held in fixture 10 additional holding force may be applied to lens holders 12 and 14 by attaching U-shaped clamp 20 as previously described. For a molded lens the manufacturing process can include the following steps. The lens is removed from the mold and placed in centering fixture 80 with first and second lens holders 12 and 14. Central support position 38 may be pressed into recesses in shaft 89 so that holders 12 and 14 and lens 16 may rotate as a unit to remove flash and mold gates left on the lens during the molding process. Clamp 20 and/or clip 18 may then be attached to the assembled lens holders 12, 14 and lens 16 and the entire assembly may be placed in the drill press for drilling various holes in the lens, for example the staking holes used to hold the plastic filament support haptics described in previously mentioned U.S. Pat. No. 4,159,546. Clamp 20 may then be removed and the entire assembly 10 may be tumbled in abrasive tumbler 72.

For a one-piece lens where the optic and the haptic are formed of one piece of plastic like that shown in U.S. Pat. No. 4,261,065, the edges of the haptic supports can be rounded by placing the optic between the confronting surfaces of lens holders 12 and 14, clipping the assembly together and then placing the entire assembly in an abrasive tumbling medium in the same fashion as the optic of a filamentary support haptic lens is tumbled. The haptic supports can be smoothed in the abrasive medium, but the optical surface will be protected.

Figure 7:
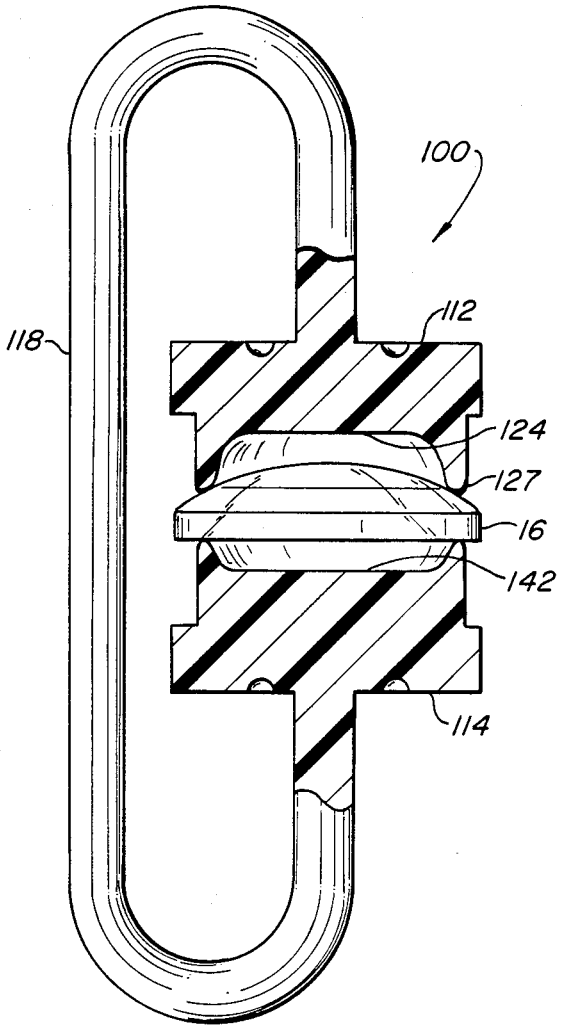
FIG. 7 shows a cross-sectional view of an alternative embodiment of the fixture of the present invention.

Referring now to FIG. 7, there is shown an alternative embodiment of the fixture of the present invention. Fixture 100 includes lens holders 112 and 114 and clip 118 which are all fashioned as a single unit preferably from molded plastics. Lens covering surfaces 124 and 142 both have the same shape with a recess 125 and a peripheral flange 127. Since lens holders 112 and 114 are preferably made of an elastomeric material, flange 127 will also be elastomeric and will form a seal with the surfaces of the lens which are placed in fixture 100 to prevent abrasives from contacting the optical surfaces of lens 16 during tumbling. This alternative embodiment has the added advantage of accepting a variety of lenses, because lens-covering surfaces 124 and 142 are not shaped to conform to the confronting surface of any particular lens. Thus, lenses of different curvature may be accepted in the same fixture 100.

The present invention provides a fixture and a manufacturing process for rounding the edges of plastic intraocular lenses using an abrasive tumbling process while protecting the central optical portion of the optical surfaces of the lens so that the optical surfaces of the lens are not affected by abrasive tumbling. The present invention has been described in conjunction with the preferred embodiments. Those skilled in the art will appreciate that many modifications and changes may be made to the preferred embodiments without departing from the present invention. It is, therefore, not intended to limit the present invention except as set forth in the appended claims.

I claim:

1. A fixture for holding an optical lens during abrasive tumbling, said lens including a central optical, a peripheral transition zone spaced radially outwardly of said central zone and an edge, said fixture comprising:

first and second generally cylindrical lens holders each having a lens-protecting surface for covering an optical surface of a lens and an exterior surface spaced axially apart from said lens-protecting surface;

resilient, unitary means for holding said lens holders with their respective lens-protecting surfaces in confronting relationship to at least the optical zone of an optical surface of said with sufficient force to substantially eliminate relative movement between said lens holders and said lens during abrasive tumbling to finish at least the edge of said lens.

2. The fixture of claim 1 wherein said holding means includes a generally U-shaped clamp wherein one leg of the "U" contacts the exterior surface of one of said lens holders and the other leg of said U-shaped clamp contacts the exterior surface of said second lens holder.

3. The fixture of claim 2 wherein said exterior surface of said lens holders each include clamp receiving means for holding said clamp securely to said lens holders.

4. The fixture of claim 1 further including clip-receiving means in each of said exterior surfaces of said lens holders; and, wherein said holding means includes a unitary resilient clip having a first end for engaging a clip-receiving means on said first holder and having a second end for engaging said clip-receiving means of said second lens holder.

5. The fixture of claim 1 wherein each of said lens holders includes a central support portion extending coaxially with said exterior surface of said lens holder and said support portion including a coaxial bore; and, wherein said holding means includes a unitary resilient clip having a first end cooperating with the bore of said first lens holder and having a second end cooperating with the bore of said second lens holder;

wherein said holding means further includes a generally U-shaped unitary clamp wherein one leg of the "U" contacts the exterior surface of one said lens holders and the other leg of said U-shaped clamp contacts the exterior surface of said second lens holder; and, each leg of said U-shaped clamp has a bifurcated end so that said clamp may be slid past said central support portions.

6. The fixture of claim 1 wherein each of said lens holders includes a radially extending flange having a diameter equal to the diameter of the lens to be held by said fixture, said flange adapted to align said lens and said holders along a common axis.

7. The fixture of claim 1 further including a generally cylindrical unitary centering fixture for aligning said first and second lens holders and said lens along a common axis, said centering fixture including a generally annular housing having a central bore of uniform diameter;

said housing having an open end and a partially closed end;

said partially closed end having a recess extending axially into the partially closed end wall a first predetermined distance, said housing having a slot extending completely through the annular wall of said housing and extending through the partially closed end of said housing;

said centering fixture adapted to receive a first lens holder, a lens and a second lens holder in succession;

said housing slot adapted to receive a clip for engaging the opposite exterior surfaces of said first and second lens holders to clip said holders and said lens together in centered fashion so that they will stay properly aligned when removed from said centering fixture.

8. The fixture of claim 7 wherein said housing includes an axially extending groove along the inside of said housing wall.

9. The apparatus of claim 6 wherein said radially extending flange extends axially from said exterior surface of each lens holder toward said lens-covering surface a sufficient distance to provide a bumper for preventing large objects from inadvertently touching the lens held by said fixture during tumbling of said lens.

10. The apparatus of claim 1 wherein at least one of said lens holders includes a planar lens-holding surface.

11. The fixture of claim 1 wherein at least one of said lens holder covering surfaces includes a concave surface for holding a convex lens.

12. The fixture of claim 1 further including a gasket disposed at least partially between one of said lens-protecting surfaces for providing a tight seal between said lens holder and said lens surface to prevent foreign substances from entering between said lens and said lens holder lens-protecting surface.

13. The apparatus of claim 12 wherein said gasket is placed between each of said lens-protecting surfaces and the confronting surfaces of said lens.

14. The apparatus of claim 1 further including an O-ring disposed between the confronting lens-protecting surface of each lens holder and said lens.

15. The fixture of claim 1 further including a wax film disposed between at least one lens-protecting surface of said lens holder and the confronting surface of said lens.

16. The fixture of claim 1 further including an adhesive disposed between at least one lens-protecting surface of said lens holder and the confronting surface of said lens.

17. The fixture of claim 1 further including a rubber disc disposed between at least one lens-protecting surface of said lens holder and the confronting surface of said lens.

18. The fixture of claim 1 wherein said holding means is integrally connected to each of said lens holders.

19. The fixture of claim 1 wherein said lens holders are made of an elastomeric material and said lens-protecting surface of each lens holder includes a central recess and a peripheral flange surrounding said recess;

said flange providing a tight seal against the confronting surface of a lens.

20. A centering fixture for alinging an optical lens and associated lens holders along a common axis so that the lens and lens holders may be properly aligned to facilitate a subsequent tumbling process comprising;

an annular housing with a partially closed end and said housing including a slot through the side wall and through the partially closed end of said housing to permit said lens and said lens holders to be clipped together to be held in proper alignment during said tumbling process;

a groove extending axially along the interior wall of said annular housing;

a recess in said partially closed end of said housing for receiving projecting extending from one of said lens holders.

21. The centering fixture of claim 20 wherein the recess extends all the way through the partially closed end of the housing.

* * * * *